US009360829B2

(12) United States Patent
Makino et al.

(10) Patent No.: US 9,360,829 B2
(45) Date of Patent: Jun. 7, 2016

(54) IMAGE PROCESSING APPARATUS INCLUDING TWO PORTIONS FOR RECEIVING DISCHARGED SHEET

(71) Applicant: Brother Kogyo Kabushiki Kaisha, Nagoya-shi, Aichi-ken (JP)

(72) Inventors: Masato Makino, Kariya (JP); Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/520,483

(22) Filed: Oct. 22, 2014

(65) Prior Publication Data

US 2015/0117927 A1 Apr. 30, 2015

(30) Foreign Application Priority Data

Oct. 30, 2013 (JP) ..... 2013-225271

(51) Int. Cl.

| | |
|---|---|
| ***G03G 15/00*** | (2006.01) |
| ***G03G 21/16*** | (2006.01) |
| *G03G 21/14* | (2006.01) |

(52) U.S. Cl.

CPC ..... *G03G 21/1633* (2013.01); *G03G 15/50* (2013.01); *G03G 15/6573* (2013.01); *G03G 21/14* (2013.01); *G03G 2215/00421* (2013.01); *G03G 2215/0141* (2013.01)

(58) Field of Classification Search

CPC . G03G 15/50; G03G 15/234; G03G 15/6573; G03G 15/6552; G03G 21/14; G03G 2215/00421; B65H 31/02; B65H 31/24

See application file for complete search history.

(56) References Cited

U.S. PATENT DOCUMENTS

| | | | | |
|---|---|---|---|---|
| 4,853,752 | A * | 8/1989 | Takahashi et al. | 355/77 |
| 6,177,977 | B1 * | 1/2001 | Tanaka et al. | 355/26 |
| 8,165,486 | B2 | 4/2012 | Yasuda | |
| 2009/0035041 | A1 * | 2/2009 | Yang | 399/401 |
| 2009/0208237 | A1 | 8/2009 | Yasuda | |
| 2010/0247117 | A1 | 9/2010 | Tomatsu | |
| 2011/0135325 | A1 * | 6/2011 | Hitaka et al. | 399/21 |

FOREIGN PATENT DOCUMENTS

| | | | |
|---|---|---|---|
| JP | H09-328249 | A | 12/1997 |
| JP | 2000-015893 | A | 1/2000 |
| JP | 2002-145504 | A | 5/2002 |
| JP | 2009-180917 | A | 8/2009 |
| JP | 2010-230853 | A | 10/2010 |

* cited by examiner

*Primary Examiner* — Blake A Tankersley

(74) *Attorney, Agent, or Firm* — Banner & Witcoff, Ltd.

(57) ABSTRACT

In an image processing apparatus, a control device controls a releasing member to release a release object onto a sheet to perform an image processing; controls a first rotating body to rotate to convey the sheet on which the releasing member has released the release object; controls a second rotating body to rotate to convey the sheet whose leading edge has passed through the first rotating body; determines whether a cover is in an open position or a close position relative to a housing of the image processing apparatus based on a signal outputted by a cover sensor; and restricts, when the cover is determined to be in the open position based on the signal, a rotation of the second rotating body while the first rotating body rotates.

14 Claims, 6 Drawing Sheets

IMAGE PROCESSING APPARATUS INCLUDING TWO PORTIONS FOR RECEIVING DISCHARGED SHEET

CROSS REFERENCE TO RELATED APPLICATION

This application claims priority from Japanese Patent Application No. 2013-225271 filed Oct. 30, 2013. The entire content of the priority applications is incorporated herein by reference.

TECHNICAL FIELD

The present invention relates to an image processing apparatus.

BACKGROUND

A conventional image processing apparatus that includes a direct discharging mechanism is known. For example, an image forming apparatus disclosed in US Patent Application Publication No. 2010/247117A1 includes: a paper discharge tray formed in an upper portion of the apparatus; a conveyance path for guiding a sheet that has passed through an image formation unit toward the paper discharge tray and for changing a conveying direction of the sheet from horizontal to upward; a direct discharging mechanism for discharging horizontally the sheet of paper that has passed through an image formation unit before the sheet reaches the paper discharge tray; a rear cover serving as a part of the direct discharging mechanism and switching, between horizontal or upward depending on an open-or-closed state of the rear cover, the conveying direction of the sheet that has been conveyed in the horizontal direction after passing through the image formation unit; an open-or-close detection mechanism for detecting the open-or-closed state of the rear cover; and an intermediate discharge roller for rotating in a forward direction to convey the sheet toward the paper discharge tray and for rotating in a reverse direction in the case of both-side printing to put the sheet on a conveyance path leading to the image formation unit again.

SUMMARY

However, the trailing end portion of the sheet might not be completely discharged due to properties of the sheet, such as size and stiffness, or the shape of the paper discharge tray on which sheets are discharged and stacked in the direct discharging. In this case, the trailing end portion of the sheet might be caught up by rotating bodies such as the intermediate discharge roller provided on the downstream side of the direct discharging mechanism. For example, when the sheet is to be discharged to the paper discharge tray designed for direct discharging, the leading edge of the sheet could hit a convex portion formed on the paper discharge tray, thereby making it difficult to get the trailing end portion of the sheet out of the image forming apparatus. In such a case, the sheet could be caught up by the rotating bodies.

In view of the foregoing, it is an object of the invention to provide an image processing apparatus for preventing the sheet from being caught up by the rotating bodies for conveying the sheet, as the direct discharging fails.

In order to attain the above and other objects, the invention provides an image processing apparatus that may include a housing, a releasing member, a first discharge portion, a forward conveyance path, a first rotating body, a second rotating body, a cover, a second discharge portion, a cover sensor, and a control device. The housing has an opening. The releasing member may be disposed in the housing and be configured to release a release object onto a sheet. The sheet has a leading edge. The first discharge portion may be configured to receive thereon the sheet on which the release object has been released. The sheet may be conveyed along the he forward conveyance path in a conveying direction from the releasing member to the first discharge portion when the cover is in the close position. The first rotating body may be disposed at the forward conveyance path. The second rotating body may be disposed at the forward conveyance path and be positioned between the first rotating body and the first discharge portion. The second rotating body may be configured to rotate in a forward direction to convey the sheet toward the first discharge portion along the forward conveyance path. The cover may be configured to move relative to the housing between a close position and the open position. In the close position, the cover may cover the opening and a part of the forward conveyance path may be provided between the first rotary body and the second rotary body. In the open position, the cover may expose the opening to an outside and the sheet which has been passing through the releasing member and the first rotating body may be delivered to an exterior of the housing. The second discharge portion may be configured to receive the sheet thereon when the cover is in the open position. The first rotating body may be configured to rotate to convey the sheet toward the second rotating body along the part of the forward conveyance path when the cover is in the close position. The first rotating body may be configured to rotate to discharge the sheet onto the second discharge portion through the opening when the cover is in the open position. The part of the forward conveyance path may disappear when the cover is in the open position. The cover sensor may be configured to output a first signal indicative of whether the cover is disposed in the open position or in the closed position. The control device may be configured to: control the releasing member to release the release object onto the sheet to perform an image processing; control the first rotating body to rotate to convey the sheet on which the releasing member has released the release object; control the second rotating body to rotate in the forward direction to convey the sheet whose leading edge has passed through the first rotating body; determine whether the cover is in the open position or the close position based on the first signal outputted by the cover sensor; and restrict, when the cover is determined to be in the open position based on the first signal, a rotation of the second rotating body while the first rotating body rotates.

In this case, if the image processing apparatus is an image formation apparatus, the "release object" includes toner or ink. If the image processing apparatus is an image reading device, the "release object" includes light. If the image processing apparatus is an image formation apparatus, the "releasing member" includes a photoreceptor or a recording head. If the image processing apparatus is an image reading device, the "releasing member" includes a reading sensor. The phrase "restrict the rotation of the second rotating body" means that the rotation of the second rotating body is stopped, that the rotation speed of the second rotating body is decreased, and that the rotation direction of the second rotating body is reversed.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
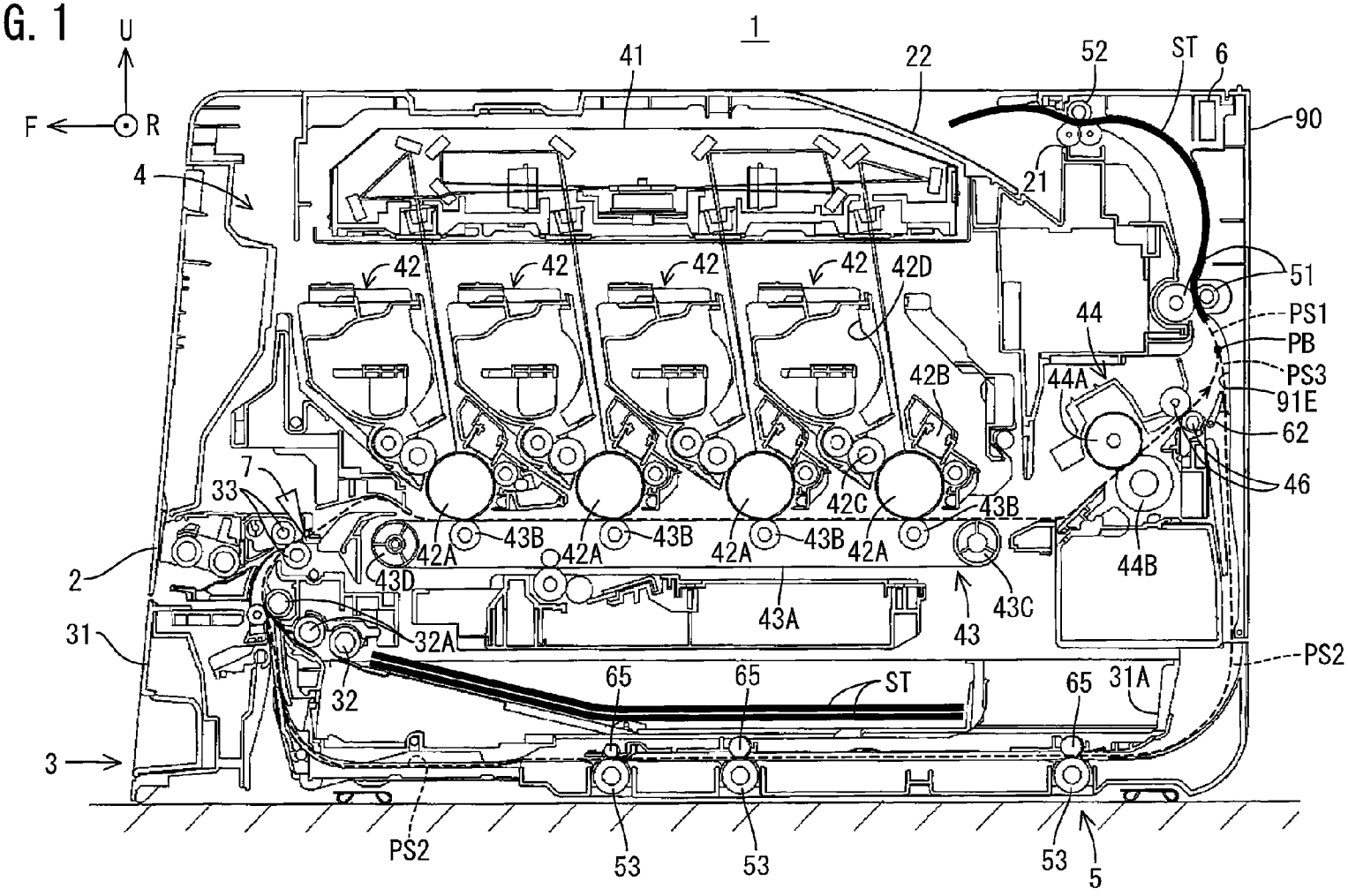
FIG. 1 is a cross-sectional side view of an image processing apparatus according to an embodiment of the present invention.

A printer 1 according to an embodiment of the present invention will be described with reference to FIGS. 1 to 6. The printer 1 serving as an example of an image processing apparatus is a tandem-type color printer. In the description below, the left side on paper of FIG. 1 is referred to as the front side (F) of the printer 1, the front side on paper of FIG. 1 as the right side (R) of the printer 1, and the upper side on paper of FIG. 1 as the upper side (U) of the printer 1. Incidentally, dotted line PS1 of FIG. 1 represents a forward conveyance route for sheets ST. Dotted line PS2 represents a reverse conveyance route for sheets ST.

1. Overall Configuration of Printer

As shown in FIG. 1, the printer 1 is an image forming apparatus configured to form an image on both sides of a sheet ST of paper. The printer 1 includes a housing 2, a sheet feed unit 3, an image formation unit 4, a roller mechanism 5, and a rear cover 90. Incidentally, the sheets ST may be made of plastic instead of paper, as long as the sheets ST are printable. The housing 2 has an opening 2*a* (FIG. 2) for accessing inner components disposed in the rear portion of the housing 2.

The sheet feed unit 3 is provided in a lower portion of the housing 2. The sheet feed unit 3 includes a sheet tray 31, a pickup roller 32, a plurality of supply rollers 32A, and a pair of registration rollers 33. The sheet tray 31 includes a storage section 31A in which a plurality of sheets ST are stored. The pickup roller 32 and each of the supply rollers 32A are configured to start to rotate on the basis of supply instructions from a control unit 81 (described later, FIG. 3). The pickup roller 32 and the supply rollers 32A are configured to carry each of the sheets ST stored in the sheet tray 31 toward the image formation unit 4. Incidentally, each of the rollers 32 is configured to be driven and rotated by a drive motor 54A of a roller drive unit 54 (described later, FIG. 3) in a direction in which the sheets ST are conveyed. The pair of registration rollers 33 is configured to adjust the posture of the sheet ST being conveyed.

The image formation unit 4 is configured in such a way as to form an image on the sheet ST conveyed from the sheet feed unit 3. The image formation unit 4 includes an exposure unit 41, a plurality of process units 42, a transfer unit 43, and a fixing unit 44. In the embodiment of FIG. 1, four process units 42 are provided.

The exposure unit 41 is provided in an upper portion of the housing 2. The exposure unit 41 includes a laser source (not shown), a polygon mirror (whose reference number is omitted), a plurality of lenses (those reference numbers are omitted), and a plurality of reflecting mirrors (those reference numbers are omitted). The exposure unit 41 is configured to expose the peripheral surface of each photosensitive drum 42A to a laser beam emitted from the laser source on the basis of image data.

The plurality of process units 42 are disposed between the sheet tray 31 and the exposure unit 41 in the up-down direction and arranged in a front-rear direction. Each process unit 42 includes the photosensitive drum 42A, a charger 42B, a developing roller 42C, and a toner storage unit 42D. The configurations of the process units 42 are almost identical. The process units 42 are different from each other only in terms of the color (e.g. black, yellow, magenta, or cyan) of the toner stored in the toner storage units 42D. Accordingly, only the components of one process unit 42 are denoted by reference numbers. Toner serves as an example of a release object, colorant, or developer.

During an image formation process, the charger 42B charges the photosensitive drum 42A and the exposure unit 41 exposes the charged photosensitive drum 42A on the basis of image data. The developing roller 42C transfers the toner from the toner storage unit 42D to the exposed photosensitive drum 42A. The photosensitive drum 42A serves as an example of a releasing member and is configured to release the toner to the sheet ST when the transfer process is executed by the transfer unit 43.

The transfer unit 43 is provided between the sheet tray 31 and the process units 42. The transfer unit 43 includes a drive roller 43C; a driven roller 43D; an endless conveyor belt 43A wound around the drive roller 43C and the driven roller 43D; and four transfer rollers 43B. The conveyor belt 43A is disposed in such a way that an outer surface thereof is in contact with each photosensitive drum 42A, and that each transfer roller 43B is located on an inner side thereof. The conveyor belt 43A is sandwiched between the transfer rollers 43B and the photosensitive drums 42A.

The fixing unit 44 is provided behind the process units 42. The fixing unit 44 includes a heating roller 44A; and a pressure roller 44B. The pressure roller 44B is disposed so as to face the heating roller 44A and presses the heating roller 44A. On the downstream side of the fixing unit 44 in a sheet conveying direction, a pair of first discharge rollers 46 serving as an example of a first rotating body is provided. When the rear cover 90 is in an open state, the sheets ST are discharged out of the housing 2 through the opening 2*a* by driving of the first discharge rollers 46. Furthermore, on the downstream side of the first discharge rollers 46 in the sheet conveying direction, a pair of intermediate rollers 51 serving as an example of a second rotating body is provided. The pair of intermediate rollers 51 is disposed at the forward conveyance path PS1 and positioned between the pair of first discharge rollers 46 and the discharge tray 22. The rotation direction of the intermediate rollers 51 can be changed. Specifically, the pair of intermediate rollers 51 is configured to rotate in the forward direction to convey the sheet ST toward the discharge tray 22 along the forward conveyance path PS1, and to rotate in the reverse direction opposite to the forward direction. During both-side printing, a control unit 81 described later controls the intermediate rollers 51 to rotate in the reverse direction to convey the sheet toward the photosensitive drum 42A along the reverse conveyance path PS2.

A second discharge roller 52 and a discharge opening 21 are provided on an upper portion of the housing 2. A discharge tray 22 serving as an example of a first discharge portion is provided on the upper surface of the housing 2. The discharge tray 22 is configured to receive thereon the sheet ST on which the photosensitive drum 42A has been released when the rear cover 90 is in a closed state. Specifically, when the rear cover 90 is in the closed state, the first discharge rollers 46 and the intermediate rollers 51 convey the sheet ST has passed through the fixing unit 44 and discharge the sheet ST onto the discharge tray 22 through the discharge opening 21.

Process conveyance systems that constitute the image formation unit 4, such as the photosensitive drums 42A, the transfer unit 43, and the fixing unit 44, are driven and rotated by a process drive unit 45 (described later, FIG. 3) so as to convey the sheet ST.

A forward conveyance path PS1 and reverse path PS2 are defined in the housing 2. The forward conveyance path PS1 has a part PS3 formed between the first discharge rollers 46 and the intermediate rollers 51. The sheet ST is conveyed along the forward conveyance path PS1 in a sheet conveying direction from the photosensitive drum 42A to the discharged tray 22 when the rear cover 90 is in the closed state. The reverse path PS2 diverges from the forward conveyance path PS1 at a diverging point PB. The diverging point PB is defined between the first discharge rollers 46 and the intermediate rollers 51. The reverse path PS2 is configured to guide the sheet ST downward from the diverging point PB and then guide the sheet ST toward the photosensitive drums 42A.

A flapper 62 is provided behind the fixing unit 44 and the first discharge roller 46. The flapper 62 is formed so as to be able to swing in the front-rear direction. The flapper 62 is configured to close the forward conveyance path PS1 when the sheet ST is being guided to the reverse path PS2. A plurality of conveyance rollers 53 and a plurality of sub rollers 65 are provided at the reverse path PS2. The plurality of conveyance rollers 53 faces the plurality of sub rollers 65, respectively. These rollers 53 and 65 are configured to sandwich the sheet ST therebetween and convey the sheet ST from the diverging point PB to the photosensitive drums 42A.

The roller mechanism 5 functions as a discharge mechanism for discharging the sheet ST conveyed from the image formation unit 4 out of the hosing 2. The roller mechanism 5 also functions as a re-conveying unit configured to convey the sheet ST to the image formation unit 4 again after an image has been formed on one side of the sheet ST by the image formation unit 4, and then the sheet ST is flipped upside down.

Figure 2:
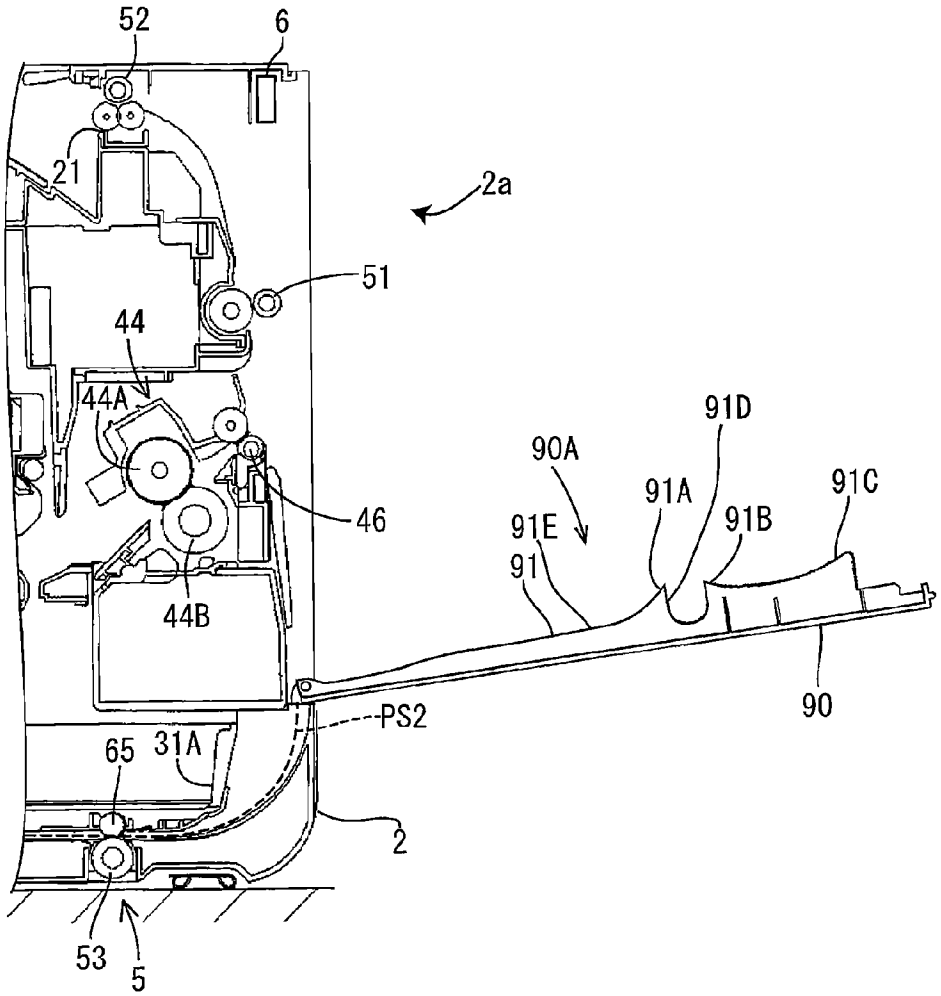
FIG. 2 is an enlarged view of the image processing apparatus of FIG. 1 when a rear cover is opened.

The rear cover 90 is provided in the rear portion of the housing 2. The rear cover 90 is configured to move relative to the housing 2 between a closed state (close position) where the part PS3 of the forward conveyance path PS1 is formed between the first discharge rollers 46 and the intermediate rollers 51, and an open state (open position) where the sheet ST that has passed through the photosensitive drums 42A and the first discharge rollers 46 is delivered to an exterior of the housing 2. In other words, when the rear cover 90 is in the closed state, the rear cover 90 covers the opening 2*a* and the part PS3 is provided between the first discharge rollers 46 and the intermediate rollers 51. However, in the open state as shown in FIG. 2, the rear cover 90 exposes the opening 2*a* to an outside and the sheet ST is discharged through the opening 2*a* onto the back surface of the rear cover 90. In other words, the rear cover 90 forms a second discharge portion 90A onto which the sheet ST is directly discharged rearward. That is, the rear cover 90 doubles as a tray on which the sheet ST is placed. The second discharge portion 90A is configured to receive the sheet ST thereon when the rear cover 90 in the open state. The rear cover 90 serves as example of the cover.

The rear cover 90 (the second discharge portion 90A) includes a sheet stacked surface 91 onto which the sheet ST is discharged to the exterior of the housing 2 through the opening 2*a* when the rear cover 90 is in the open state. In the sheet stacked surface 91 includes a first rib 91A serving as an example of a rib, and a second rib 91B, a shallow concave section 91C, a concave section 91D, and a guide portion 91E. The sheet stacked surface 91 is the back surface of the rear cover 90 and faces the inner portion of the printer in the closed state. In the closed state, the part PS3 of the first conveyance path PS1 disappears. The sheet stacked surface 91 is configured to receive thereon the sheets ST that have been delivered to the exterior of the housing 2 by the first discharge rollers 46 when the rear cover 90 is in the open state. Each of the first rib 91A and the second rib 91B is provided on the sheet stacked surface 91 and has a convex shape. The shallow concave section 91C is formed between the second rib 91B and the leading edge of the sheet stacked surface 91. The concave section 91D has a concave shape and is formed between the ribs 91A and 91B in such a way as to surround the intermediate rollers 51 when the rear cover 90 is closed. The guide portion 91E faces the first conveyance path PS1 and is configured to guide the sheet ST when the cover is closed.

The rib 91A is formed into a shape for guiding, to a position where the paired intermediate rollers 51 are in contact with each other, the sheet ST being conveyed along the sheet stacked surface 91 that serves as the part PS3 of the forward conveyance path PS1 when the rear cover 90 is in the closed state. Accordingly, when the rear cover 90 is in the closed state, the sheet ST conveyed along the sheet stacked surface 91 is guided by the rib 91A, and then is held by the intermediate rollers 51. That is, the rib 91A is provided on the rear cover 90 in such a way as to help discharge the sheet ST outside in a suitable manner when the rear cover 90 is in the closed state. As described later, the present embodiment can prevent the sheet ST from being caught up due to the rib 91A even as the rear cover 90 is in the open state or as the sheet ST is directly discharged.

2. Electric Configuration of Printer

Figure 3:
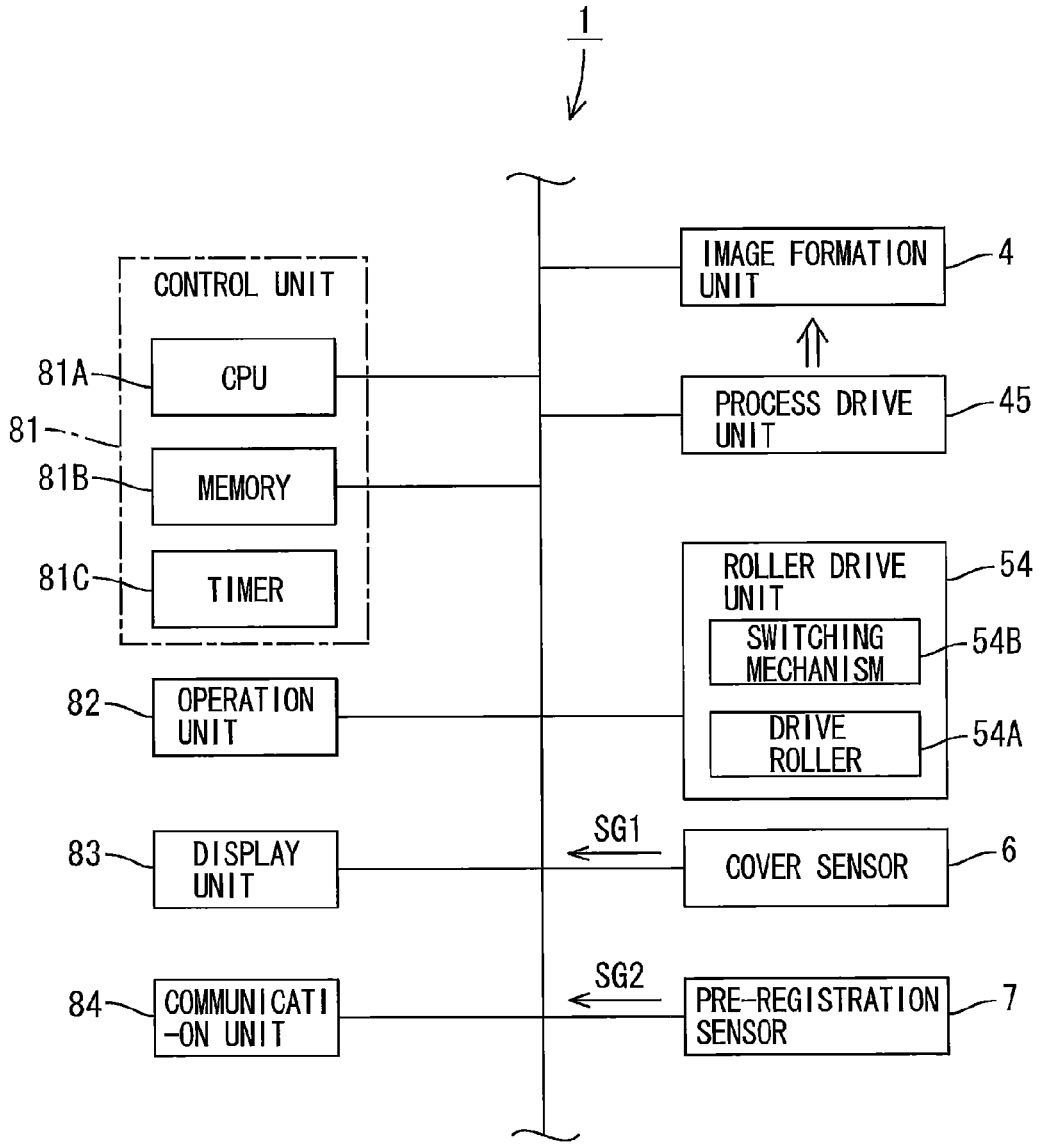
FIG. 3 is a block diagram showing the image processing apparatus according to the embodiment.

As shown in FIG. 3, the printer 1 includes the control unit 81, the image formation unit 4, the process drive unit 45, the roller drive unit 54, a cover sensor 6, a post-registration sensor 7, an operation unit 82, a display unit 83, and a communication unit 84.

The control unit 81 includes a central processing unit 81A (referred to as CPU, hereinafter), a memory 81B, and a timer 81C. The memory 81B includes ROM and RAM. The ROM stores a program for executing a roller rotation control process (described later) and programs for executing various kinds of operation of the printer 1. The CPU 81A is configured to control each part of the printer 1 in accordance with the programs read from the ROM. Incidentally, in addition to the ROM, the memory storing the programs may include EEPROM, CD-ROM, a hard disk device, and a flash memory (Registered Trademark). The timer 81C is configured to count and measure the time necessary for each operation to be carried out.

The operation unit 82 includes a plurality of buttons, allowing a user to perform various kinds of input operations. The display unit 83 includes a liquid crystal display or lamps, and is configured to display various kinds of setting screens and the operation state of the printer 1. The communication unit 84 is configured to exchange data with an external device via a communication line. The control unit 81 is configured to receive print data from the external device via the communication unit 84.

As shown in FIG. 1, the cover sensor 6 is provided in an upper portion of the housing 2 and near the rear cover 90. The cover sensor 6 is configured to generate a detection signal SG1 depending on whether the rear cover 90 is opened or closed. The cover sensor 6 is configured to output or transmit, to the control unit 81, the detection signal SG1 indicative of whether the rear cover 90 is disposed in the closed state or the open state. The detection signal SG1 serves as an example of a first signal.

The post-registration sensor 7 is provided near the registration rollers 33 and on the downstream side of the registration rollers 33 in the sheet conveyance direction. In other words, the post-registration sensor 7 is provided closer to the upstream side than the photosensitive drum 42A is, in a direction in which the sheet ST travels from the photosensitive drum 42A to the first discharge rollers 46. The post-registration sensor 7 is configured to generate and output a detection signal SG2 depending on whether or not the sheet ST exists at a detection position near the registration rollers 33. The post-registration sensor 7 is configured to transmit the detection signal SG2 to the control unit 81. The post-registration sensor 7 serves as an example of a sheet sensor. The detection signal SG2 serves as an example of a second signal.

The roller drive unit 54 includes a switching mechanism 54B, and the drive motor 54A. The drive motor 54A is a stepping motor and serves as an example of a motor. The drive motor MA is configured to transmit a drive force to the intermediate rollers 51 and the fixing unit 44. That is, the drive motor 54A is used to drive both the intermediate rollers 51 and the fixing unit 44. The switching mechanism 54B is a well-known motor power switching mechanism that contains an electromagnetic clutch. Under the control of the control unit 81, the switching mechanism 54B transmits or blocks the drive force from the drive motor 54A to the intermediate rollers 51. In other words, the switching mechanism 54B is configured to switch a first mode in which the drive force is transmitted from the drive motor 54A to the intermediate rollers 51, and a second mode in which the drive force is not transmitted from the drive motor 54A to the intermediate rollers 51. The roller mechanism 5, the first discharge rollers 46, the roller drive unit 54, the rear cover 90, and other components constitute a direct discharging mechanism.

3. Roller Rotation Control Process

Figure 4:
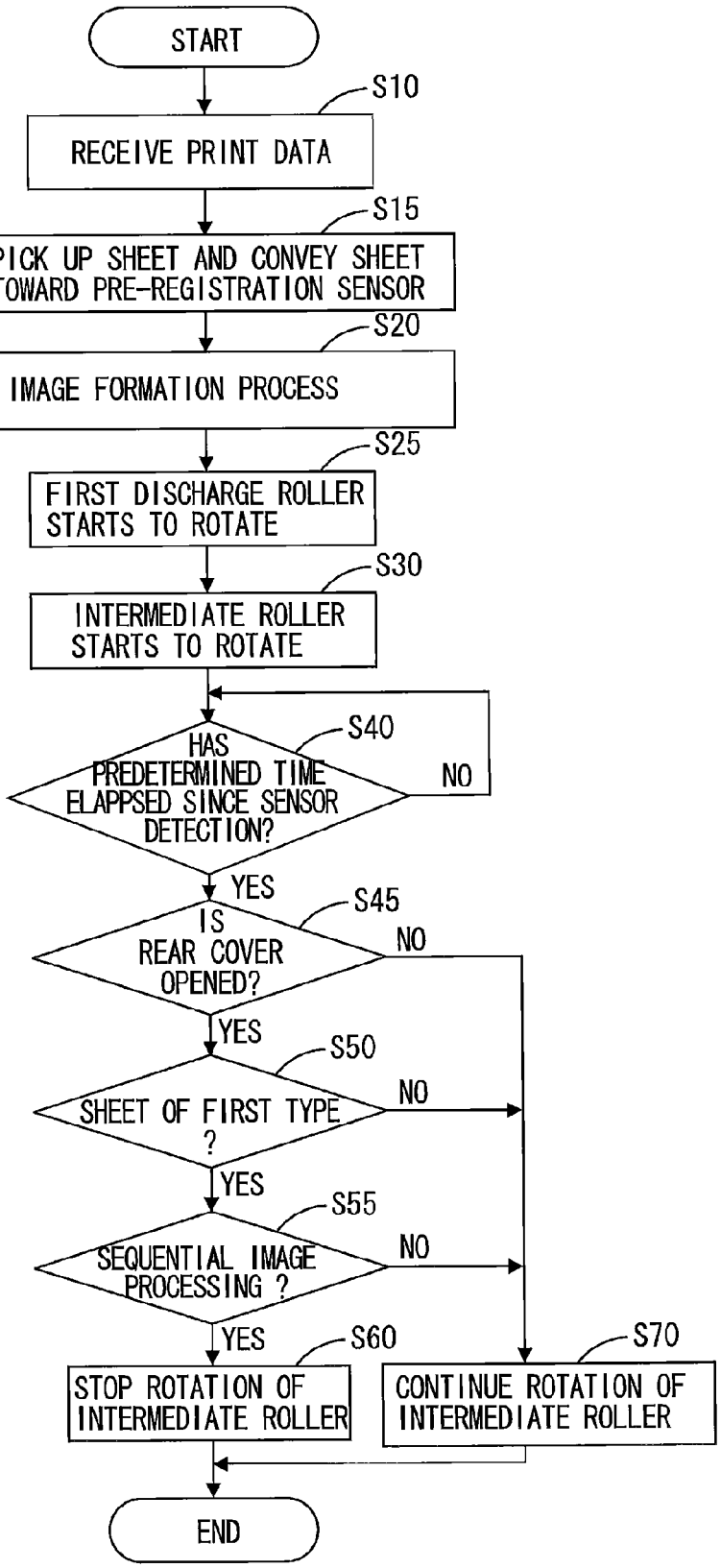
FIG. 4 is a flowchart illustrating steps in a roller rotation control process executed by the image processing apparatus according to the embodiment.
Figure 5:
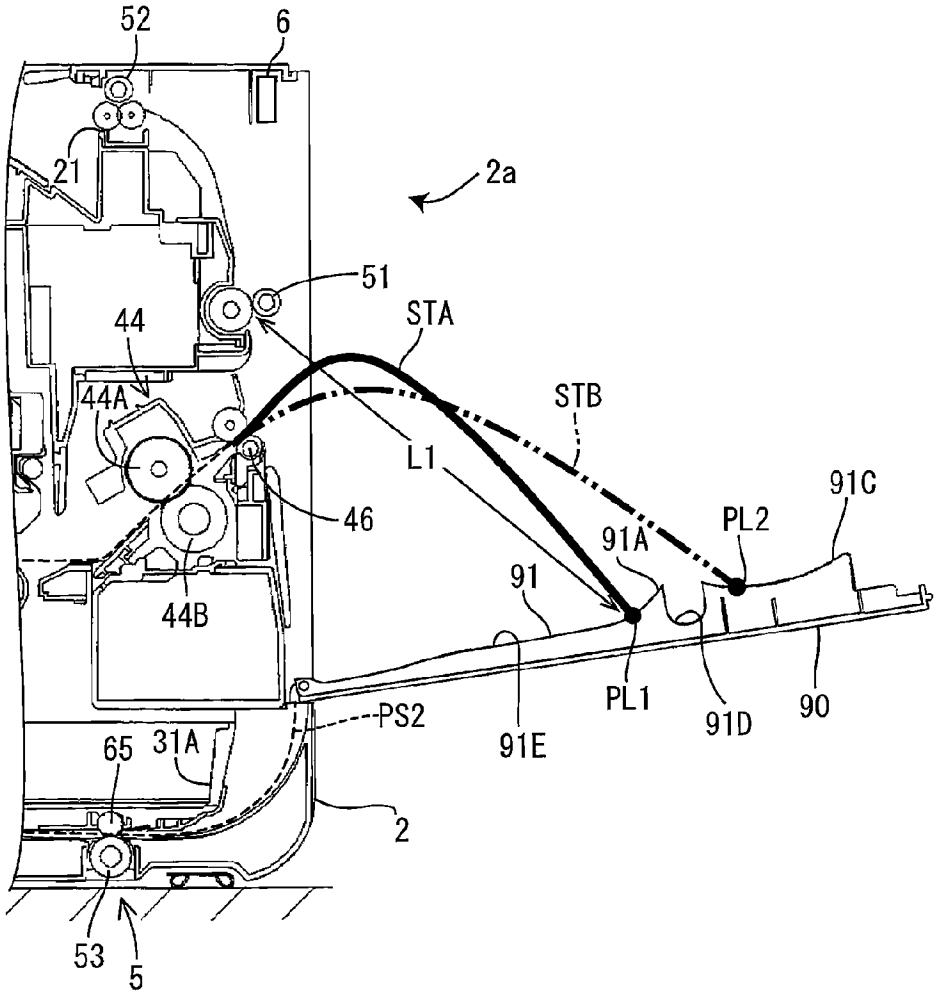
FIG. 5 is an explanatory diagram showing a state where a sheet is discharged to the rear cover.
Figure 6:
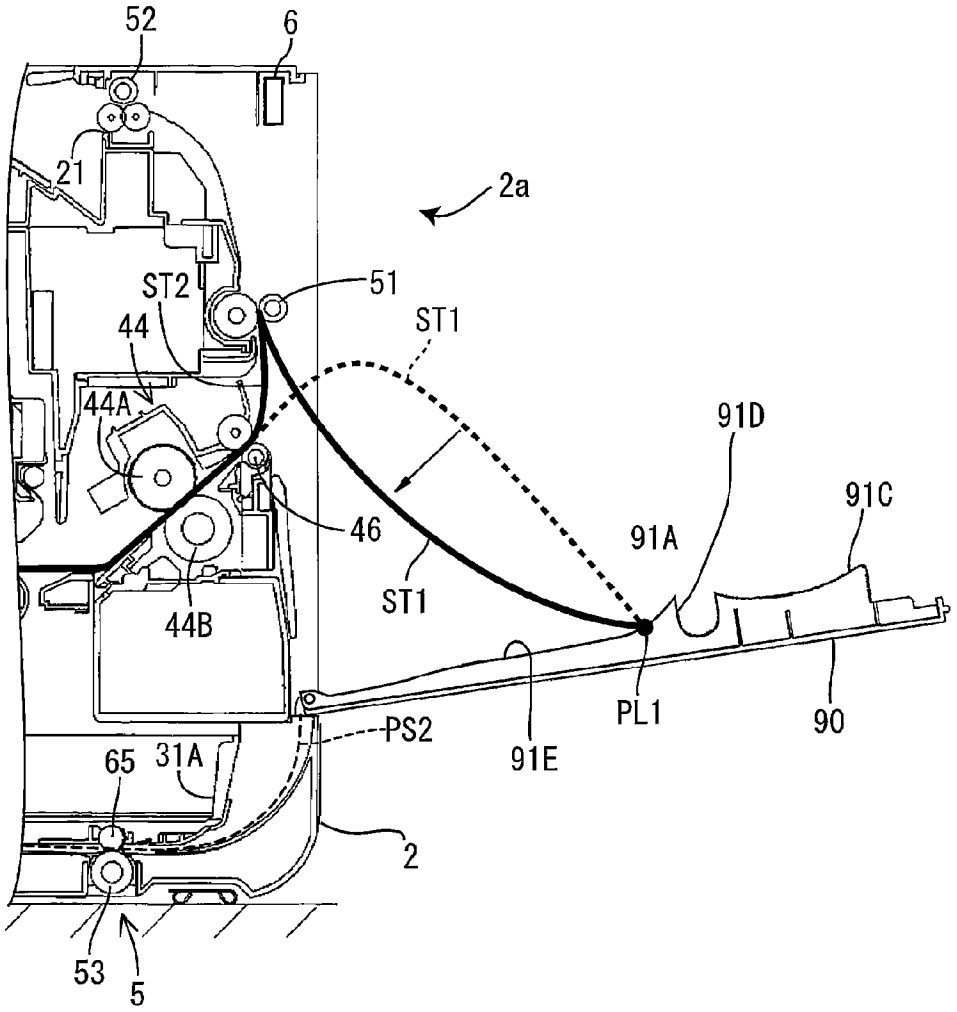
FIG. 6 is an explanatory diagram showing a state where a sheet is caught up by an intermediate roller of the image processing apparatus.

With reference to FIGS. 4 to 6, the roller rotation control process for mainly controlling the rotation of the intermediate rollers 51 will be described. For example, the CPU 81A of the control unit 81 executes the roller rotation control process when an image is to be formed on the basis of a print command that is received from an external computer via the communication unit 84.

As shown in FIG. 4, upon starting the roller rotation control process, the CPU 81A receives print data from an external computer via the communication unit 84 (S10). The print data serves as an example of image data. Then, the CPU 81A controls the rotation of the pickup roller 32 to pick up a sheet ST, and then conveys the sheet ST to the post-registration sensor 7 by controlling the rotation of the supply rollers 32A (S15).

When the sheet ST has reached the post-registration sensor 7, the post-registration sensor 7 transmits, to the control unit 81, the detection signal SG2 indicative of the existence of the sheet ST (or indicating that the sheet ST is detected). When the CPU 81A receives the detection signal SG2 indicating that the sheet ST is detected, the CPU 81A controls the image formation unit 4 to perform an image formation process to form an image on the sheet ST based on the image data (print data) using the toner (S20).

In S25, the CPU 81A starts to rotate the first discharge rollers 46 along with the image formation process by controlling the roller drive unit 54. At this time, the CPU 81A drives the first discharge rollers 46 to convey, downstream in the conveyance path PS1, the sheet ST whose leading edge has passed through the photosensitive drum 42A. More specifically, the CPU 81A controls the first discharge roller 46 to rotate so as to convey the sheet ST toward the diverging point PB. The CPU 81A also starts to rotate the intermediate rollers 51 (S30). At this time, the CPU 81A drives the intermediate rollers 51 to convey, downstream in the first conveyance path PS1, the sheet ST whose leading edge has been passed through the first discharge rollers 46.

Then, the CPU 81A determines, on the basis of a value measured by the timer 81C, whether or not a predetermined time Tpd has passed since the leading edge of the sheet ST is detected by the post-registration sensor 7 (S40).

For example, the predetermined time Tpd is a period of time to elapse from when the leading edge of the sheet ST is detected by the post-registration sensor 7 until the leading edge of the sheet ST reaches the fixing unit 44. More specifically, the predetermined time Tpd is preliminarily determined based on the distance between the post-registration sensor 7 and the fixing unit 44 and the speed of conveying the sheet ST.

If the CPU 81A determines that the predetermined time Tpd has not passed (S40: NO), the CPU 81A continues conveying the sheet ST to perform the image formation process. If the CPU 81A determines that the predetermined time Tpd has passed (S40: YES), the CPU 81A determines whether or not the rear cover 90 is opened based on the detection signal SG1 from the cover sensor 6 (S45).

If the CPU 81A determines that the rear cover 90 is not opened (S45: NO), the CPU 81A controls the intermediate rollers 51 to continue to rotate (S70) for a prescribed period of time and then ends the roller rotation control process. The reason is that, when the rear cover 90 is closed, the sheet ST is not directly discharged onto the sheet stacked surface 91.

If the CPU 81A determines that the rear cover 90 is opened (S45: YES), the CPU 81A determines whether or not the sheet ST is a paper sheet STA of a first type (S50). In this embodiment, the paper sheet STA of the first type and a paper sheet STB of a second type can be used as the sheet ST.

As indicated by solid line in FIG. 5, when the sheet STA is being delivered to the exterior of the housing 2 by the first discharge rollers 46, the leading edge of the first-type paper sheet STA lands at a landing point PL1 on the sheet stacked surface 91 and the trailing end portion of the first-type paper sheet STA is held between the first discharge rollers 46. The landing point PL1 is closer to the first discharge rollers 46 than the first rib 91A.

As indicated by two-dot chain line in FIG. 5, when the paper sheet STB is being delivered to the exterior of the housing 2 by the first discharge rollers 46, the leading edge of the paper sheet STB lands at a landing point PL2 on the sheet stacked surface 91 and the trailing end portion of the paper sheet STB is held between the first discharge rollers 46. The landing point PL2 is defined on the opposite side of the second rib 91B relative to the first discharge rollers 46. That is, the landing point PL2 for the second-type paper sheet STB is further from the first discharge rollers 46 than the landing point PL1 for the first-type paper sheet STA is. In other words, the first rib 91A is formed between the landing points PL1 and PL2.

Incidentally, the intermediate rollers 51 are disposed in such a way that the linear distance L1 between the intermediate rollers 51 and the first landing point PL1 is shorter than the length of the first-type paper sheet STA in the conveying direction.

If the CPU 81A determines that the sheet ST is not the first-type paper sheet STA, or that the sheet ST is the second-type paper sheet STB (S50: NO), the CPU 81A controls the intermediate rollers 51 to continue to rotate for a prescribed period of time (S70) and then ends the roller rotation control process. If the sheet ST is to be directly stacked on the sheet stacked surface 91 and the sheet ST is a second-type paper sheet STB, the sheet ST (STB) is stacked on the sheet stacked surface 91 without the leading edge of the sheet ST contacting the first rib 91A.

If the CPU 81A determines that the sheet ST is the first-type paper sheet STA (S50: YES), the CPU 81A determines whether or not the image processing is a sequential image processing for forming a single image on a plurality of sheets ST (S55). Specifically, in the sequential image processing, a plurality of divisional images constituting the single image are sequentially formed on the plurality of sheets ST, respectively.

If the CPU 81A determines that the image processing is not the sequential image processing (S55: NO), the CPU 81A controls the intermediate rollers 51 to continue to rotate for a prescribed period of time (S70) and then ends the roller rotation control process. If the image processing is not the sequential image processing (that is, there is only one paper sheet ST) and the sheet ST is to be directly stacked on the sheet stacked surface 91, the sheet ST is more unlikely to be caught up by the intermediate rollers 51 than when a plurality of sheets ST are sequentially conveyed, even as the leading edge of the sheet ST contacts the first rib 91A.

As shown in FIG. 6, the trailing end portion of the first paper sheet ST1 is first discharged to the sheet stacked surface 91 and then is pressed by the leading edge of a subsequent second sheet ST2. The trailing end portion of the first paper sheet ST1 therefore is dropping off from the first discharge rollers 46. As a result, the first paper sheet ST1 deforms as indicated by solid line from the state indicated by broken line. Moreover, the discharge of the second sheet ST2 onto the paper stacking surface 91 is hampered by the first paper sheet ST1. The second sheet ST2 then moves toward the intermediate rollers 51, and the deformed first paper sheet ST1 follows and moves toward the intermediate rollers 51. As a result, as shown in FIG. 6, the first and second sheets ST1 and ST2 are likely to be caught up, possibly causing a jam. Incidentally, the paper sheets that were caught up as described above were actually confirmed.

If the CPU 81A determines that the image processing is the sequential image processing (S55: YES), the CPU 81A halts or stops the rotation of the intermediate rollers 51 (S60), and then ends the roller rotation control process. In other words, the CPU 81A restricts the rotation of the pair of intermediate rollers 51 in S60. At this time, the CPU 81A switches the switching mechanism 54B to block the drive force to the intermediate rollers 51, thereby stopping the rotation of the intermediate rollers 51.

In this manner, the rotation of the intermediate rollers 51 is stopped when the following three conditions are satisfied: The rear cover 90 is opened (S45: YES), the sheet ST is the first-type paper sheet STA (S50: YES), and the image processing is the sequential image processing (S55: YES).

4. Advantageous Effects

According to the embodiment described above, the CPU 81A stops the rotation of the intermediate rollers 51 when three conditions are met: the rear cover 90 is opened; that the sheet ST is the first-type paper sheet STA; and that the image processing is the sequential image processing. This configuration prevents the trailing edge portion of the sheet ST from being caught up in the intermediate rollers 51 when the sheet ST is to be directly discharged through the opening 2*a* onto the sheet stacked surface 91, thereby ensuring that the sheet ST is smoothly discharged on the sheet stacked surface 91. In this case, a restriction process for halting the rotation of the intermediate rollers 51 is performed when the above-described three conditions are satisfied. Therefore, the CPU 81A does not perform the restriction process repeatedly, and can avoid performing the restriction process as much as possible.

The printer 1 is an electrophotographic image forming apparatus using toner as colorant. The above-described configuration can prevent the sheet ST from being caught up by the intermediate rollers 51. Accordingly, the printer 1 can prevent the sheet ST on which an image has been formed with the colorant from being bent or damaged. As a result, a decrease in quality is curbed.

In the above-described embodiment, the CPU 81A performs the process of determining whether the rear cover 90 is opened or closed (S45) based on the signal SG2 that is output from the post-registration sensor 7 (S15), after the predetermined time Tpd has elapsed since the signal SG2 indicating that the sheet ST exists is detected. The predetermined time Tpd is appropriately set with the execution time for the restriction process. Accordingly, the execution of the restriction process can prevent the sheet ST from being caught up by the intermediate rollers 51 when the sheet ST is to be directly discharged on the rear cover 90, even if the rear cover 90 is opened after the conveying of the sheet ST starts.

The process of stopping the rotation of the intermediate rollers 51 (S60 in FIG. 4) is one example of the restriction process. Stopping the rotation of the intermediate rollers 51 can more reliably prevent the sheet ST from being caught up by the intermediate rollers 51 than slowing down the driving speed of the intermediate rollers 51.

Further, as described above, the linear distance L1 between the intermediate rollers 51 and the first landing point PL1 is shorter than the length of the first-type paper sheet STA in the conveying direction. According to the positional configuration of the intermediate rollers 51 and the first landing point PL1, the possibility is high that the first-type paper sheet STA will be caught up in the intermediate rollers 51 (See FIG. 5). However, stopping the intermediate rollers 51*a* can prevent the first-type paper sheet STA from being caught up in the intermediate rollers 51.

<Modifications>

While the invention has been described in detail with reference to the embodiment thereof, it would be apparent to those skilled in the art that various changes and modifications may be made therein without departing from the spirit of the invention.

(1) The CPU 81A may perform the restriction process when the CPU 81A receives the signal SG1 indicative of the open state of the rear cover 90 from the cover sensor 6 before the sheet ST reaches the intermediate rollers 51. In this case, the restriction process is performed at timing when the sheet ST might be caught up. This configuration reduces a load on the CPU 81A without executing the restriction process repeatedly. That is, if whether or not the open-state signal is received is determined after at a timing when the sheet ST is to reach the intermediate rollers 51, the sheet ST might already reach the intermediate rollers 51 at the determination timing. In this case, the sheet ST is not discharged onto the rear cover 90 and the restriction process is useless.

In other words, the CPU 81A may perform the restriction process if a period of time between the detection timing (determining timing) and a timing when the sheet ST reaches the intermediate rollers 51 is longer than a period of time between the detection timing and a timing when the driving of the intermediate rollers 51 starts to be restricted by execution of the restriction process. According to this configuration, the restriction process for restricting the driving of the intermediate rollers 51 can be started before the sheet ST reaches the intermediate rollers 51. Therefore, this configuration reduces a load on the CPU 81A without executing the restriction process repeatedly.

As an example of the modification described above, the predetermined time Tpd may be set such that the CPU 81A receives an open-state signal corresponding to the open state of the rear cover 90 before the sheet ST reaches the intermediate rollers 51. In this case, the detection timing is preferably set such that the driving of the intermediate rollers 51 starts to be restricted before the sheet ST reaches the intermediate rollers 51.

As another example of the modification described above, a paper discharge sensor may be provided near the fixing unit 44 and on the downstream side of the fixing unit 44 in the conveying direction. With this configuration, the predetermined time Tpd may be a period of time from when the leading edge of the sheet ST is detected by the post-registration sensor 7 until the leading edge of the sheet ST is detected by the paper discharge sensor. Note that, in the embodiment described above, the predetermined time Tpd is determined based on the distance between the post-registration sensor 7 and the fixing unit 44 and the speed of conveying the sheet ST.

In the modifications described above, as the embodiment described above, the drive motor 54A is a single motor configured to transmit a drive force to the intermediate rollers 51 and the fixing unit 44. Further, the switching mechanism 54B is designed to transmit or block the drive force to the intermediate rollers 51 from the drive motor MA. During the restriction process, the CPU 81A may switch the switching mechanism MB in such a way as to block the drive force to the intermediate rollers 51 from the drive motor 54A.

In the above configuration in which one motor provides a drive force to the two sections, a predetermined mechanical operation time is required between a timing when the CPU 81A starts the restriction process and a timing when the switching mechanism 54B is actually switched to block the drive force to the intermediate rollers 51 from the drive motor 54A. Due to the mechanical operation time and the like, there may be a time lag between when the restriction process starts and when the driving of the intermediate rollers 51 starts to be restricted. In such a case, the process of restricting the driving of the intermediate rollers 51 may not start before the sheet ST reaches the intermediate rollers 51. However, in the modifications in which the driving of the intermediate rollers 51 actually starts to be restricted before the sheet ST reaches the intermediate rollers 51, the restriction process for restricting the driving of the intermediate rollers 51 starts at a timing within a range of time between when the open-state signal is detected and when the sheet ST reaches the intermediate rollers 51. Therefore, even when one motor provides a drive force to the two sections, the restriction process will start in time. In other words, when one motor provides a drive force to the two sections, the following configuration is more suitably applied: "the restriction process is performed if the detection timing is set in such a way that the period of time between the detection timing and when the sheet ST reaches the intermediate rollers 51 is longer than the period of time between the detection timing and when the driving of the intermediate rollers 51 starts to be restricted by execution of the restriction process."

(2) In the embodiment described above, the rear cover 90 doubles as the second discharge portion 90A onto which the sheet ST is directly discharged. However, the present invention is not limited this. For example, the present invention may be applied to the image processing apparatus including: a slide-type rear cover and a paper discharge tray that is separately provided from the slide-type rear cover and disposed below the slide-type rear cover. The paper discharge tray is configured to receive the paper sheet when the rear cover slides to open.

(3) In the above embodiment, the printer 1 is the tandem-type image forming apparatus. However, the present invention is not limited to this. The present invention may be applied to other color print systems, such as a four-cycle system. Moreover, the present invention is applied not only to color printers but also to monochrome printers. The present invention may be applied to printers that can print only one side of a sheet. The image forming apparatus employs not only a polygon scanning system, but also other exposure systems, such as a LED (laser) system. The image forming apparatus may be a copy machine that has a scanning function as well as a print function, or a multifunction machine that performs a plurality of functions including the print function.

(4) In the embodiment described above, the present invention is applied to an electrophotographic image forming apparatus using toner. However, the present invention is not limited to this. For example, the present invention may be applied to an inkjet-type image forming apparatus using ink as colorant. Further, the image processing apparatus may be an image reading device such as a scanner.

(5) In the embodiment described above, the control unit 81 includes the CPU 81A and the memory 81B. However, the present invention is not limited to this. The control unit 81 may be ASIC (application-specific IC), for example.

(6) The conditions for stopping the rotation of the intermediate rollers 51 are not limited to three conditions described in the embodiment. The restriction process can be performed at least when the rear cover 90 is opened.

For example, the rotation of the intermediate rollers 51 may be stopped just when the rear cover 90 is opened. That is, the processes of S50 and S55 may be omitted. With this configuration, the restriction process can prevent the sheet ST from being caught up in the intermediate rollers 51. That is, the restriction process can prevent the sheet ST from being caught up in the intermediate rollers 51, thereby ensuring that the sheet ST is smoothly discharged to the sheet stacked surface 91 of the rear cover 90.

Alternatively, the process of step S55 may be omitted. In other words, the present invention can be applied even when the image processing is not the sequential image processing (even when a single page is being printed). In this case, the rotation of the intermediate rollers 51 is stopped when the rear cover 90 is opened and the sheet ST is the first-type paper sheet STA. Usually, when the sheet ST is discharged to the sheet stacked surface 91, the leading edge of the first-type paper sheet STA is more likely to hit the rib 91A than the second-type paper sheet STB, thereby making it difficult for the rear end of the paper sheet to fall to the sheet stacked surface 91 and thus increasing the possibility of the paper sheet being caught up. Therefore, the restriction process can be performed when the first-type paper sheet STA is used. The operation of preventing the sheet ST from being caught up can be performed depending on the type of the sheet ST.

Further, the process of S50 may be omitted. In other words, the rotation of the intermediate rollers 51 may be stopped when the rear cover 90 is opened and the image processing is the sequential image processing. Usually, when a plurality of images constituting a single image are formed sequentially on a plurality of sheets ST, respectively, one of the plurality of sheets ST is far more frequently caught up than when an image is formed only on one sheet. Accordingly, the restriction process can be performed only when the image processing is the sequential image processing. This configuration can prevent the CPU 81A from carrying out complicated operations, such as repeatedly performing the restriction process.

(7) Further, the restriction process is not limited to stopping the rotation of the intermediate rollers 51. For example, the restriction process may slow down the rotation speed of the intermediate rollers 51. Alternatively, the restriction process may rotate the intermediate rollers 51 in the reverse direction, as in the case where the sheet ST is guided to the reverse path PS2 for both-side printing. These restriction processes can prevent the sheet ST from being caught up in the intermediate rollers 51 when the sheet ST is directly discharged.

(8) The detection timing for determining whether or not the rear cover 90 is opened may be set before a timing when the CPU 81A receives the image data. Usually, it is guaranteed that the driving of the intermediate rollers 51 start to be restricted before the sheet reaches the intermediate rollers 51, if the detection timing for determining whether the rear cover 90 is in the open state or in the closed state is set before the timing at which the CPU 81A receives the image data. The restriction process may be carried out only when this timing condition is satisfied. This configuration can reduce a load that might be imposed on the CPU 81A if the restriction process is excessively repeated.

(9) In the embodiment described above, the post-registration sensor 7 is used as the sheet sensor. However, the sheet sensor is not limited to the post-registration sensor 7. For example, the sheet sensor may be a pre-registration sensor that is provided near the registration rollers 33 and on the upstream side of the registration roller 33 in the sheet conveyance direction. Further, the sheet sensor may be a supply sensor that is provided near the supply rollers 32A and on the downstream side of the supply rollers 32A in the sheet conveyance direction.

(11) In the embodiment described above, the drive motor MA drives the intermediate rollers 51 and the fixing unit 44. However, the intermediate rollers 51 and the fixing unit 44 may be driven by different motors. Moreover, no switching mechanism 54B may be provided.

What is claimed is:

1. An image processing apparatus comprising:

a housing having an opening;

a releasing member disposed in the housing and configured to release a release object onto a sheet, the sheet having a leading edge;

a first discharge portion configured to receive thereon the sheet on which the release object has been released;

a forward conveyance path along which the sheet is conveyed in a conveying direction from the releasing member to the first discharge portion when a cover of the image processing apparatus is in a closed position;

a first rotating body disposed at the forward conveyance path;

a second rotating body disposed at the forward conveyance path and positioned between the first rotating body and the first discharge portion, the second rotating body being configured to rotate in a forward direction to convey the sheet toward the first discharge portion along the forward conveyance path;

the cover, the cover configured to move relative to the housing between the closed position and an open position, wherein, in the closed position, the cover covers the opening and a part of the forward conveyance path being provided between the first rotating body and the second rotating body, and wherein, in the open position, the cover exposes the opening to an outside and the sheet which has been passing through the releasing member and the first rotating body is delivered to an exterior of the housing;

a second discharge portion configured to receive the sheet thereon when the cover is in the open position, the first rotating body being configured to rotate to convey the sheet toward the second rotating body along the part of the forward conveyance path when the cover is in the closed position and being configured to rotate to discharge the sheet onto the second discharge portion through the opening when the cover is in the open position, and the part of the forward conveyance path disappearing when the cover is in the open position, the second discharge portion having:

a stacked surface onto which the sheet delivered to the exterior of the housing through the opening is stacked when the cover is in the open position, the stacked surface having:

a first landing point at which the leading edge of the sheet lands when the leading edge of the sheet is delivered to the exterior of the housing and a trailing end portion of the sheet is held by a pair of first rollers of the first rotating body if the sheet is a sheet of a first type; and a second landing point at which the leading edge of the sheet lands when the leading edge of the sheet is delivered to the exterior of the housing and a trailing end portion of the sheet is held by the pair of first rollers if the sheet is a sheet of a second type other than the first type, the second landing point is further from the pair of first rollers than the first landing point is; and a rib protruding from the stacked surface and positioned between the first landing point and the second landing point;

a cover sensor configured to output a first signal indicative of whether the cover is disposed in the open position or in the closed position; and a control device configured to:

control the releasing member to release the release object onto the sheet to perform an image processing;

control the first rotating body to rotate to convey the sheet on which the releasing member has released the release object;

control the second rotating body to rotate in the forward direction to convey the sheet whose leading edge has passed through the first rotating body;

determine whether the cover is in the open position or the closed position based on the first signal outputted by the cover sensor;

determine whether the sheet is of the first type or of the second type; and restrict, when the sheet is determined to be of the first type and the cover is determined to be in the open position based on the first signal, a rotation of the second rotating body while the first rotating body rotates.

2. The image processing apparatus according to claim 1, wherein the control device is further configured to acquire image data, wherein the release object is colorant, and wherein the image processing is an image formation, the control device being configured to control the releasing member to release the colorant onto the sheet to form an image on the sheet based on the image data.

3. The image processing apparatus according to claim 2, wherein the releasing member is a photosensitive drum and the colorant is developer.

4. The image processing apparatus according to claim 3, further comprising a fixing unit configured to fix the developer on the sheet disposed upstream of the first rotating body in the conveying direction, wherein the pair of first rollers is configured to convey, downstream in the conveying direction, the sheet that has been passing through the fixing unit.

5. The image processing apparatus according to claim 1, wherein the second rotating body includes a pair of second rollers, wherein the cover includes the second discharge portion, wherein the stacked surface has the part of the forward conveyance path when the cover is in the closed position, and wherein the rib has a shape configured to guide, toward the pair of second rollers, the sheet that has been conveyed along the part of the forward conveyance path when the cover is in the closed position.

6. The image processing apparatus according to claim 1, wherein the second rotating body is disposed such that a linear distance between the second rotating body and the first landing point is shorter than a length of the sheet of the first type in the conveying direction.

7. The image processing apparatus according to claim 1, wherein the control device is configured to restrict, when the cover is determined to be in the open position based on the first signal before the sheet reaches the second rotating body, the rotation of the second rotating body while the first rotating body rotates.

8. The image processing apparatus according to claim 7, wherein a period of time from when the cover is determined to be in the open position based on the first signal to when the sheet reaches the second rotating body is longer than a period of time from when the cover is determined to be in the open position based on the first signal to when the second rotating body is actually restricted by the control device.

9. The image processing apparatus according to claim 8, further comprising:

a motor configured to transmit a drive force to the second rotating body and a fixing unit, a switching mechanism configured to switch between a first mode in which the drive force is transmitted from the motor to the second rotating body and a second mode in which the drive force is not transmitted from the motor to the second rotating body, and wherein the control device is configured to control, when the cover is determined to be in the open position based on the first signal before the sheet reaches the second rotating body, the switching mechanism to switch from the first mode to the second mode to restrict the rotation of the second rotating body.

10. The image processing apparatus according to claim 1, further comprising a sheet sensor positioned upstream of the releasing member in a direction directed from the releasing member to the first rotating body, the sheet sensor being configured to output a second signal indicative of an existence of the sheet at a detection position, wherein the control device is further configured to determine whether or not a predetermined period of time has elapsed since the control device received the second signal from the sheet sensor, and wherein the control device is configured to determine, after the predetermined period of time has elapsed since the control device received the second signal from the sheet sensor, whether the cover is in the open position or at the closed position based on the first signal outputted by the cover sensor.

11. The image processing apparatus according to claim 1, wherein the control device is further configured to acquire image data, and wherein the control device is configured to restrict, when the cover is determined to be in the open position based on the first signal before the control device acquires the image data, the rotation of the second rotating body while the first rotating body rotates.

12. The image processing apparatus according to claim 1, wherein the control device is further configured to:

acquire image data;

determine whether or not the image data indicates a subject image, the subject image being a single image that should be formed on a plurality of sheets by dividing the single image into a plurality of divisional images, the plurality of divisional images being to be formed on a plurality of sheets, respectively, wherein the control device is configured to restrict, when the cover is determined to be in the open position based on the first signal and the image data indicates the subject image, the rotation of the second rotating body while the first rotating body rotates.

13. The image processing apparatus according to claim 1, wherein the control device is configured to halt, when the cover is determined to be in the open position based on the first signal, the second rotating body to restrict the rotation of the second rotating body while the first rotating body rotates.

14. The image processing apparatus according to claim 1, further comprising a reverse conveyance path diverging from the forward conveyance path at a diverging point when the cover is in the closed position, the diverging point being defined between the first rotating body and the second rotating body, the reverse conveyance path extending from the diverging point to the releasing member along the reverse conveyance path when the cover is in the closed position, wherein the second rotating body includes a pair of second rollers configured to rotate in the forward direction and a reverse direction opposite to the forward direction, the pair of second rollers being configured to rotate in the forward direction to convey the sheet toward the first discharge portion along the forward conveyance path, the pair of second rollers being configured to rotate in the reverse direction to convey the sheet toward the releasing member along the reverse conveyance path, and wherein the control device is configured to perform the image processing by:

controlling the releasing member to release the release object onto one surface of the sheet;

controlling the pair of second rollers to rotate in the forward direction to convey the sheet toward the first discharge portion;

controlling the pair of second rollers to rotate in the reverse direction to convey the sheet from the diverging point to the releasing member along the reverse conveyance path after the second rotating body rotated in the forward direction; and controlling the releasing member to release the release object onto another surface of the sheet that has been conveyed along the reverse conveyance path and that reaches the releasing member.

* * * * *